United States Patent [19]

Bucher

[11] 3,965,501

[45] June 29, 1976

[54] BED INTENDED FOR USE BY SICK AND INVALID PERSONS

[76] Inventor: René Bucher, Stockackerstrasse 17, CH - 4153 Reinach, Switzerland

[22] Filed: Mar. 24, 1975

[21] Appl. No.: 561,640

[30] Foreign Application Priority Data

Apr. 5, 1974 Switzerland ..... 4776/74

[52] U.S. Cl. ..... 5/90; 4/174; 5/65

[51] Int. Cl.[2] ..... A47K 3/12; A61G 7/02

[58] Field of Search ..... 5/65, 63, 64, 60, 90, 5/91; 4/173, 174, 185 AB, 179

[56] References Cited

UNITED STATES PATENTS

| | | | |
|---|---|---|---|
| 531,202 | 12/1894 | Maben | 4/174 |
| 2,215,636 | 9/1940 | Comper | 5/90 X |
| 2,500,738 | 3/1950 | Beem | 5/90 |
| 2,805,426 | 9/1957 | Rempel | 4/179 |
| 2,873,456 | 2/1959 | Joy | 5/65 |
| 2,961,665 | 11/1960 | Burthe | 5/90 |
| 3,407,411 | 10/1968 | Stevens | 4/179 X |
| 3,701,170 | 10/1972 | Bond | 4/174 |

FOREIGN PATENTS OR APPLICATIONS

| | | | |
|---|---|---|---|
| 27,306 | 5/1884 | Germany | 4/174 |

*Primary Examiner*—James T. McCall
*Attorney, Agent, or Firm*—Werner W. Kleeman

[57] ABSTRACT

A bed intended for use by sick and invalid persons comprising a bed frame and a bed cushion. The bed cushion embodies a cushion element and an upper portion arranged above the cushion element and carried by a vertically adjustable support frame. There is provided a cushion element-displacement or movement device which serves to remove the cushion element out of the region of the upper portion and to bring such again below such upper portion. The bed frame is equipped with a trough provided with a closable discharge into which there can be lowered the upper portion of the bed cushion when the cushion element is removed.

8 Claims, 9 Drawing Figures

BED INTENDED FOR USE BY SICK AND INVALID PERSONS

BACKGROUND OF THE INVENTION

The present invention relates to a new and improved construction of bed intended for use by sick and invalid persons.

In hospitals, nursing homes and similar institutions there are available for the patients normally beds equipped with an adjustment mechanism serving to raise one or a number of sections of the bed upholstery or cushioning and therefore to accommodate the lying or repose surface to the requirements of the patients.

In the case of sick and invalid persons who can only get out of the bed with assistance by third parties or no longer can even leave the bed, considerable problems exist especially as concerns washing or hygienic care of the body and carrying out the normal human bodily functions. When carrying out the normal toilet functions assisted by an attendant most patients have an uncomfortable feeling, apart from the fact that such assistance is extremely time-consuming for the hospital attendant or the like. Patients who are still in possession of their complete mental faculties find it extremely disturbing if they require the assistance of an attendant. Additionally, many older people who have difficulty in getting around, and who otherwise would not need any intensive care, are forced to go to a hospital or nursing home because of the previously mentioned reasons.

SUMMARY OF THE INVENTION

Hence, it is a primary object of the present invention to provide an improved construction of bed for use by sick and invalid persons considerably facilitating carrying out the aforementioned functions by the patient without assistance.

Another and more specific object of the invention aims at the provision of a novel construction of bed which allows the patient who cannot get out of bed to wash himself without the assistance of an attendant or another person.

Now in order to implement these and still further objects of the invention, which will become more readily apparent as the description proceeds, the bed of the instant invention, and which is contemplated for use by sick and invalid persons, comprises a bed frame and a bed cushion or upholstering. The bed cushion comprises a cushion element and an upper portion arranged above the cushion element and supported by a vertically adjustable support frame. There is further provided a cushion element-displacement device which serves the purpose of removing the cushion element out of the region of the upper portion and to again bring such below such upper portion. The bed frame possesses a trough equipped with a closable discharge or outlet and into which trough there can be lowered the upper portion of the bed cushion when the cushion element has been removed.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 7:
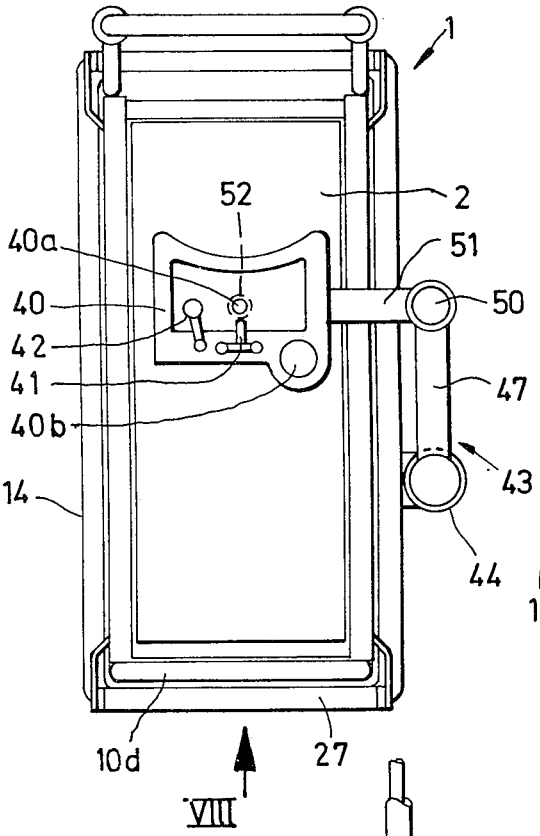
FIG. 7 is a plan view corresponding to the showing of FIG. 2, but on a reduced scale, of the bed and a wash basin attached thereto.
Figure 8:
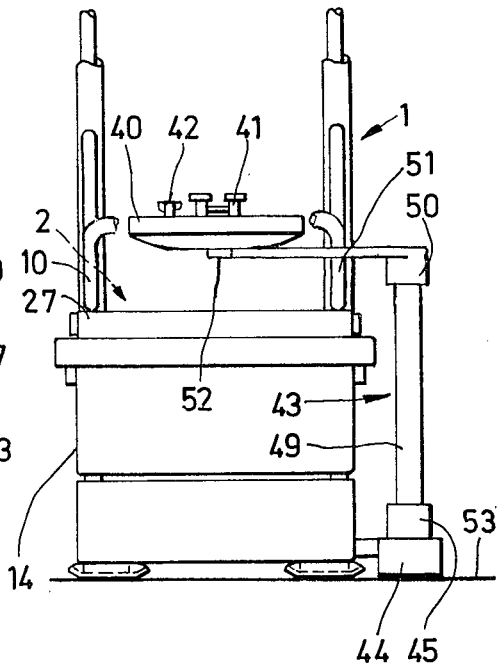
FIG. 8 is a end view of the bed and the wash basin on the same scale as shown in FIG. 7 and looking in the direction of the arrow VIII of FIG. 7.
Figure 9:
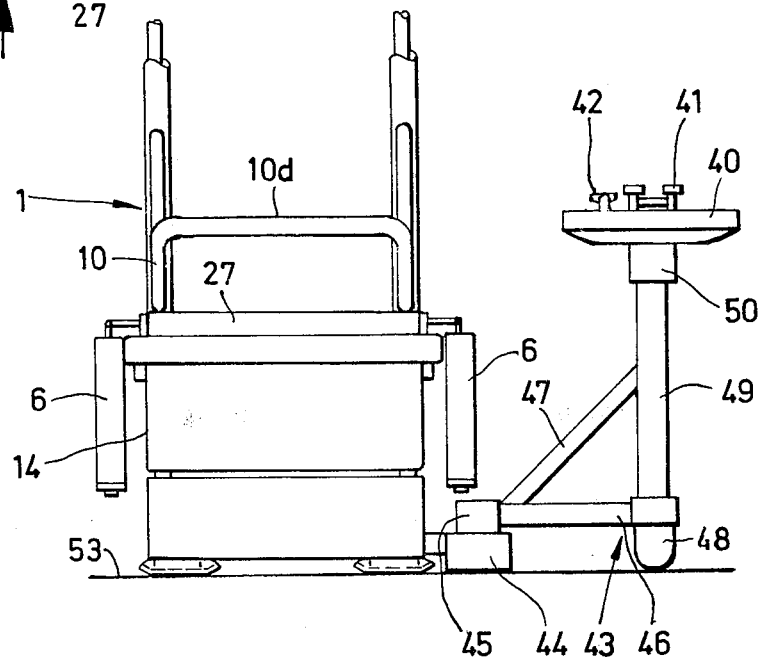
FIG. 9 is a front view corresponding to the showing of FIG. 8, wherein however in this instance the wash basin has been shifted into a different position and the cushion element-components have been outwardly pivoted.

Describing now the drawings, the bed intended for use by sick and invalid persons is shown approximately reduced tenfold in scale in FIGS. 1, 2, 4 and 5 and approximately twentyfold in scale in FIGS. 7, 8 and 9 and such bed will be understood to comprise a bed frame designated in its entirety by reference character 1 and a bed cushion or upholstering designated in its entirety by reference character 2. The bed cushion 2 comprises an upper portion or component 4 consisting of plastic which is provided at the region of its central portion with a large opening **4*a*. Moreover, the upper portion 4 is constructed in a net-like or grate-like manner and equipped with small openings 4*b* as apparent by referring to the detail sectional showing of FIG. 3 which is portrayed approximately to scale. Below the upper portion or component 4 there is arranged an intermediate component or portion 5 likewise composed of plastic and which is visible in plan view in the showing of FIG. 2 where there has been omitted the upper portion 4. Below the intermediate portion 5 there is located a cushion element consisting of two components or portions 6 and which form the actual upholstery or cushioning for the bed cushion 2. Finally, below the cushion element 6 there is arranged a lower portion or component 7 consisting of plastic and exhibiting a large opening 7*a* and small openings 7*b***.

The bed frame 1 possesses a tubular frame 3 which is secured through the agency of any suitable connection or attachment elements or pieces 8 at two runners 9 bearing against the floor or other supporting surface for the bed. The tubular frame 3 comprises two vertically extending tubular or pipe sections **3*a* located at the head end of the bed, and these two tubular sections 3*a* are interconnected with one another at their upper ends by a horizontally extending section or portion 3*b*. There is also provided a support frame 10 formed by a pipe or tube, support frame 10 exhibiting two horizontal longitudinal sections 10*a* which extend in the lengthwise direction of the bed. At the head end of the bed the support frame 10 is equipped at both sides with a respective section or portion 10***b* which extends essentially vertically. The ends of the sections 10*b* are each attached to one hollow cylinder member 11 arranged coaxially with respect to the associated one of the vertical tubular sections or portions 3*a*. These hollow cylinders 11 are interconnected at their upper ends by a transverse strut or brace 12 at which there is attached a cantilever or overhang arm, which has not been particularly referenced, and provided with the handgrip 13. Moreover, both of the hollow cylinder members 11 are displaceable along the tubular portions 3*a*, so that the support frame 10 is also vertically adjustable. This support frame 10 is provided at the lower or foot end of the bed with two further vertical portions or sections 10*c* which are interconnected with one another at their upper ends by a horizontal portion or section 10*d* extending in the transverse direction of the bed.

Continuing, the bed frame 1 possesses a trough 14 which is secured by not particularly illustrated means at the tubular frame 3 and equipped with a discharge or outlet 15 which can be closed by means of a spherical-shaped closure element 16. The bed frame 1 additionally possesses a toilet bowl 17 with a discharge 18 which is arranged such that its marginal portion 19 is located at the central region of the trough floor 14*a*, yet extends somewhat above the latter. Moreover, the connection between the toilet bowl 17 and the trough floor 14*a* is sealingly closed by not particularly illustrated yet conventional sealing means. At the marginal portion 19 there is furthermore arranged a seating ring 20 forming the seating surface. The bed frame also possesses a casing or enclosure element 21 of vat-shaped or trough-shaped construction and surrounding the space between the trough 14 and the runners 9.

At this point there will be explained in greater detail the construction and the movement possibilities of the bed cushion 2. Both of the components or parts 6 of the cushion element which extend in the lengthwise direction of the bed and are separated from one another by a vertical partition or separation surface 6*a* are connected by somewhat elastically deformable mandrels or spike-like pins 22 formed for instance of a polyamide at two metallic supports 23 extending in the lengthwise direction of the bed. At the ends 23*a* of the supports 23, and which ends are somewhat offset towards the outside, there is secured a respective rod 24, as best seen by referring to FIG. 5, which is pivotably connected via a hinge or pivot 26 with a further rod 25. Both of the rods which consist for instance of a polyamide are advantageously somewhat elastically bendable. At the head end and foot end of the bed there is secured at the edge 14*b* of the trough 14 a respective guide member 27 extending in the transverse direction of the bed. These guides or guide members 27 each have a throughpassing or continuous opening 27*a* in which there are displaceably guided the rods 24 and 25 serving as guide elements for the cushion element-component 6. At the ends of the guide members 27 there is secured a respective foamed plastic element 28. In the normal repose position both of the cushion element-components 6 are located in the position portrayed in FIGS. 1, 2 and 3 below the upper component or portion 4 and the intermediate portion 5 and are held in such position by the supports 23. Both of the cushion element-components 6 are additionally supported by the lower portion 7. It is to be recognized that this lower portion 7 is connected by means of bendable connection elements 29, for instance formed of a suitable plastic, with the profile rods 30 and 31 secured at the head end and foot end, respectively, of the bed at the support frame 10, these profile rods extending in the transverse direction of the bed.

The guides or guide members 27, the rods 24 and 25 as well as not particularly illustrated traction or pulling cables which engage at the latter collectively form together with a likewise not particularly illustrated pulling or traction device serving for pulling the traction cables the cushion element-movement device 24, 25 and 27. Such makes it possible to selectively laterally remove the two-component cushion element 6 out of the region of the upper portion 4 and to bring such again below such upper portion 4 respectively.

At the longitudinal sections or portions 10*a* of the support frame 10 there are secured, preferably by means of a weld connection, the profile rods 32 which extend in the lengthwise direction of the bed. Such form the support surface for the edge of the upper portion or component 4. In order to insure that the upper portion 4 does not undesirably shift, and as best seen by referring to FIG. 3, it can be provided with the pins or plugs 4*c* which engage into matching or appropriate openings in both of the profile rods or rod members 32. The profile rods 30 and 31 are also advantageously used as support surfaces. The edges of the upper portion 4 are additionally equipped with support brackets 4*d*. At the support brackets 4*d* which are located at the edge of the upper component 4 at the head end and foot end, respectively, there engage traction or pulling cables 33 and 34 respectively, which are guided in the support frame 10 and which serve for lifting the respective head end and foot end section of the upper portion 4 and thus appropriately altering the position of the person lying upon the upper portion 4. In order to prevent painful impact against the longitudinal sections or portions 10*a* of the support frame 10 such are provided at the inner side with a foamed plastic portion 35, as best seen by referring to FIG. 3.

The intermediate component or portion 5 located between the upper portion 4 of the bed cushion 2 and the cushion element 6 is shorter than the cushion element and connected via the traction or pulling cables 36 and 37 with the support frame 10. The traction cables 36 and 37 are deflected by deflection rollers or rolls 38 secured at the profile rods 30 and 31 and finally guided through the openings of the tubes forming the support frame 10 to a drive mechanism, so that the intermediate portion 5 can be displaced in the lengthwise direction of the bed. This intermediate portion 5 possesses a large opening 5*a* and a number of small openings 5*b*. When the intermediate portion 5 is located in the terminal position depicted in FIG. 2, then its large opening 5*a* is in alignment with the large openings 4*a* and 7*a* of the upper portion 4 and the lower portion 7, respectively, and with the seating ring 20 bounding the opening of the toilet bowl 17. On the other hand, if the intermediate portion 5 is displaced into its other terminal position, then, the opening 5*a* arrives at the neighborhood of the foot end or lower end of the bed, so that the intermediate portion 5 now covers the opening of the toilet bowl 17. The previously described construction of bed permits the person reclining thereon to bathe without having to leave the bed.

Figure 1:
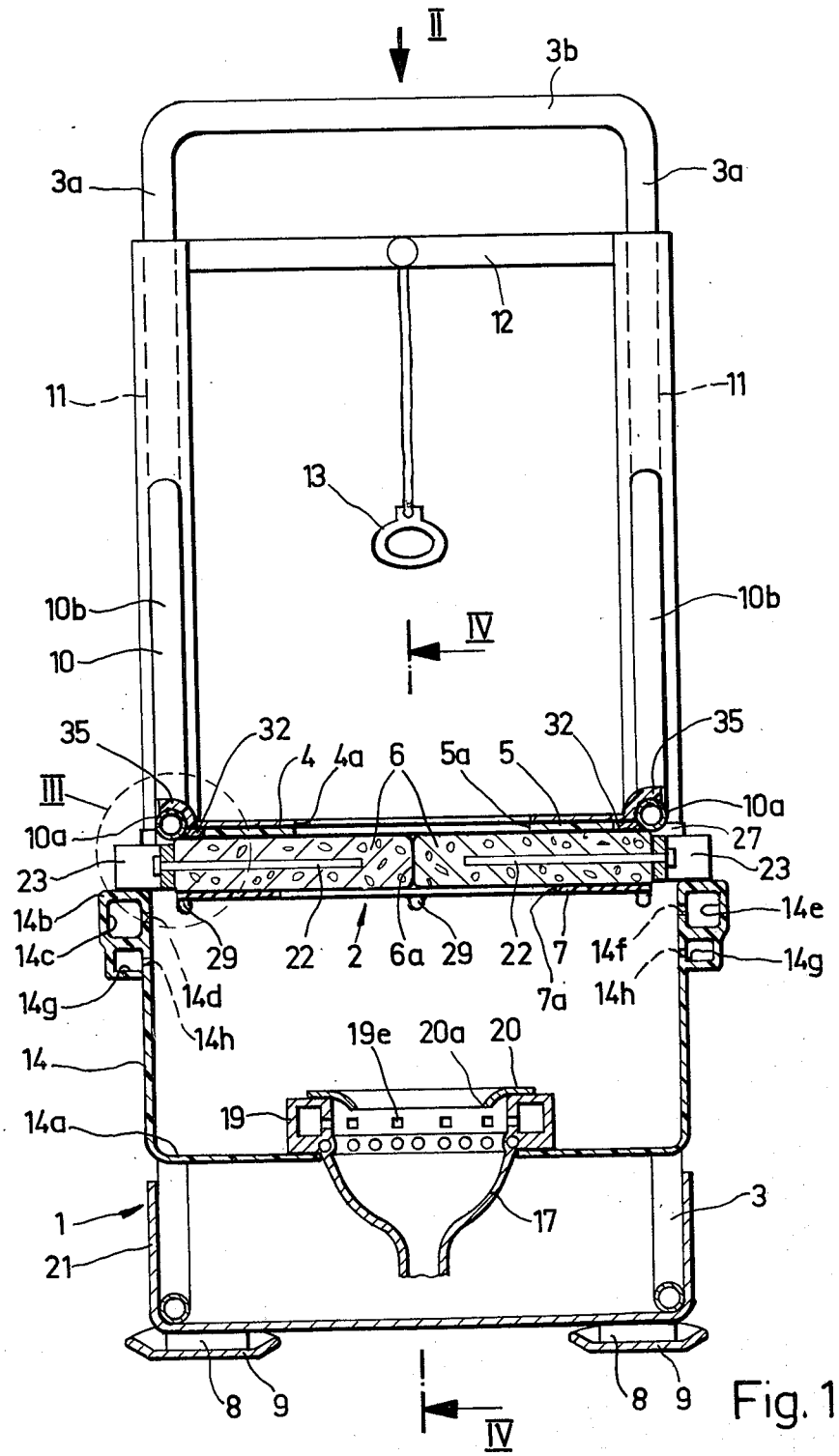
FIG. 1 is a cross-sectional view through a bed constructed according to the invention, taken substantially along the line I—I of FIG. 2.
Figure 2:
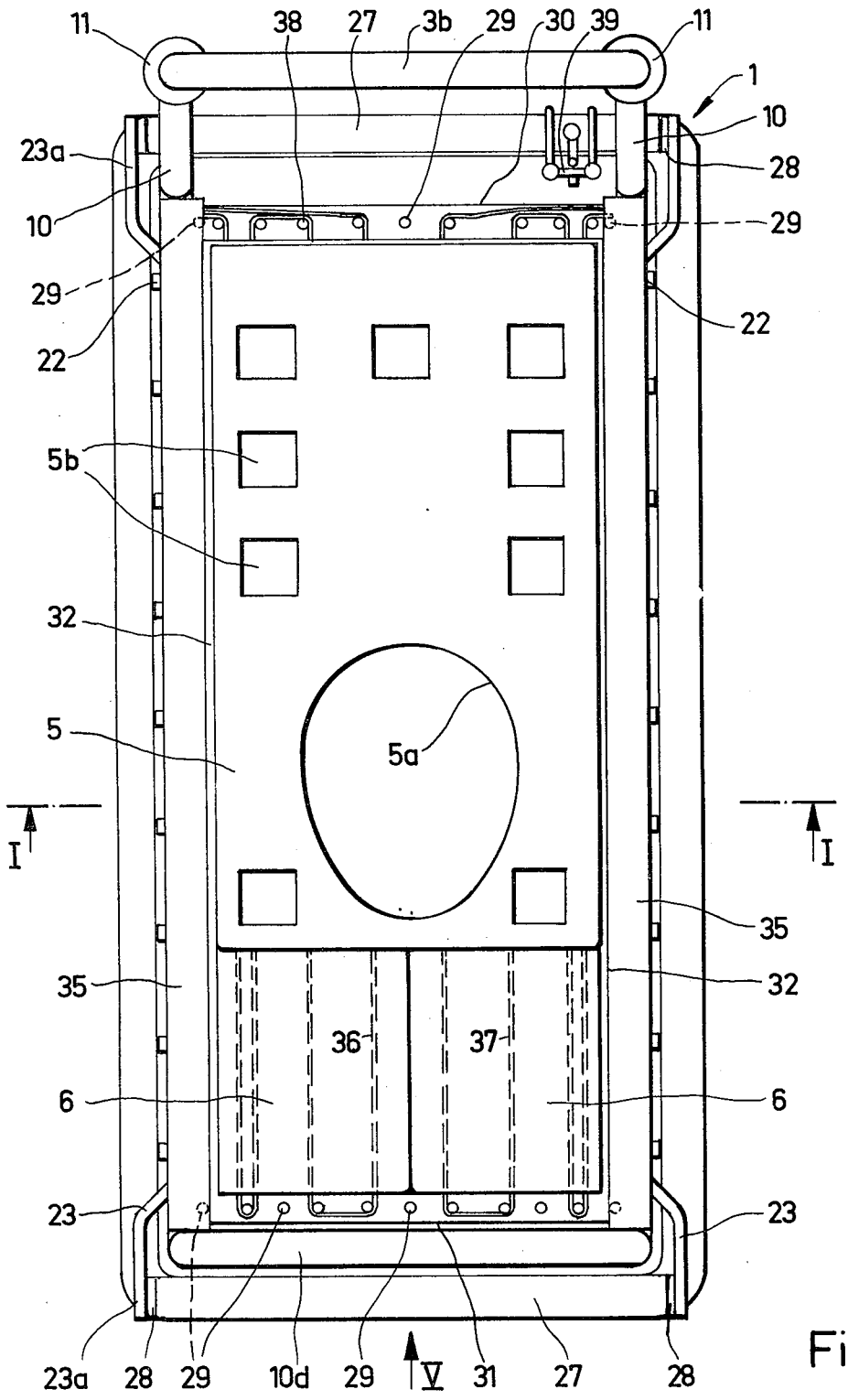
FIG. 2 is a plan view of the bed shown in FIG. 1 looking in the direction of the arrow II.
Figure 3:
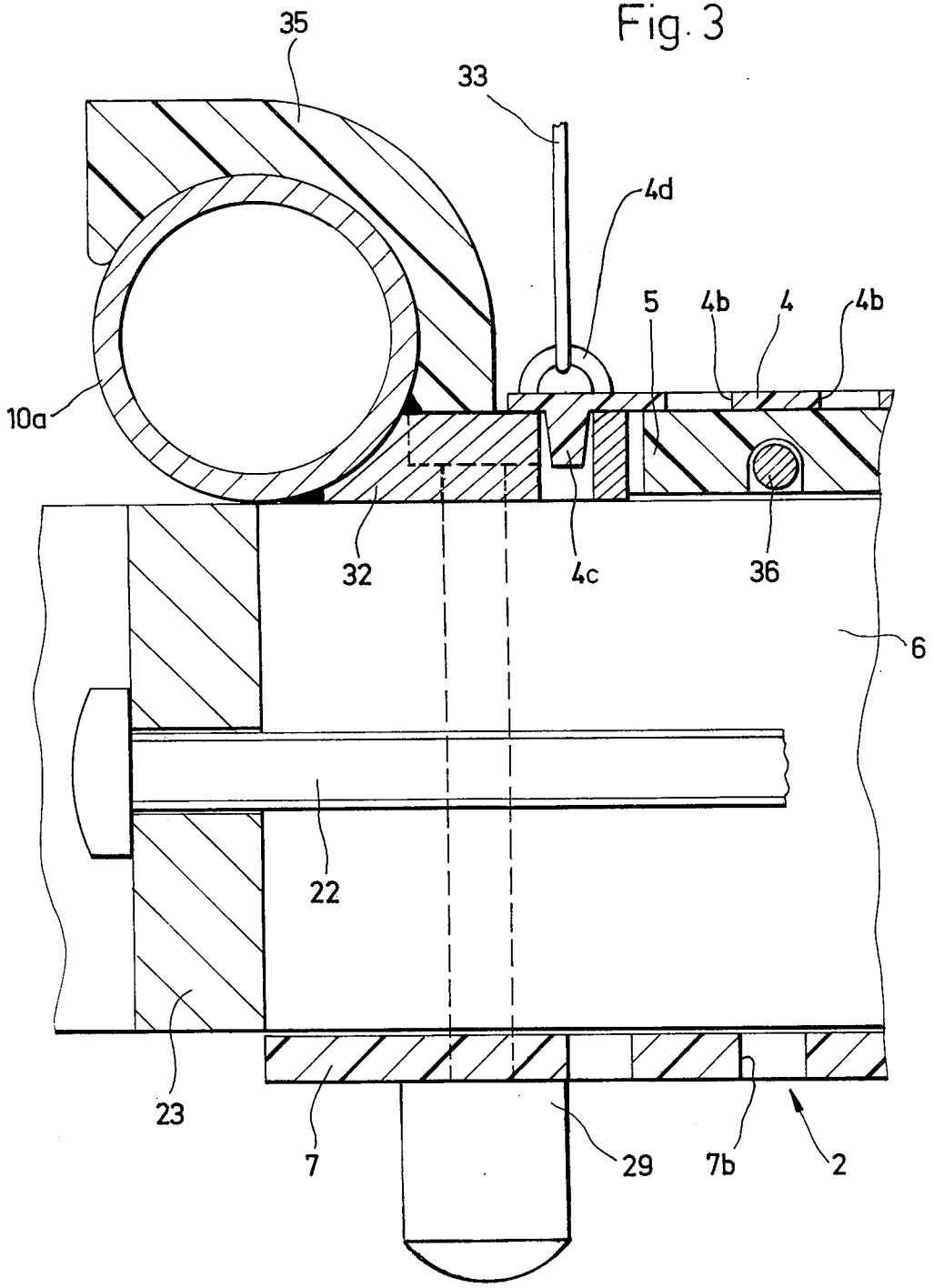
FIG. 3 is an enlarged detail showing, approximately on a scale corresponding to the actual size, and which detail is bounded by the line designated III in FIG. 1.
Figure 4:
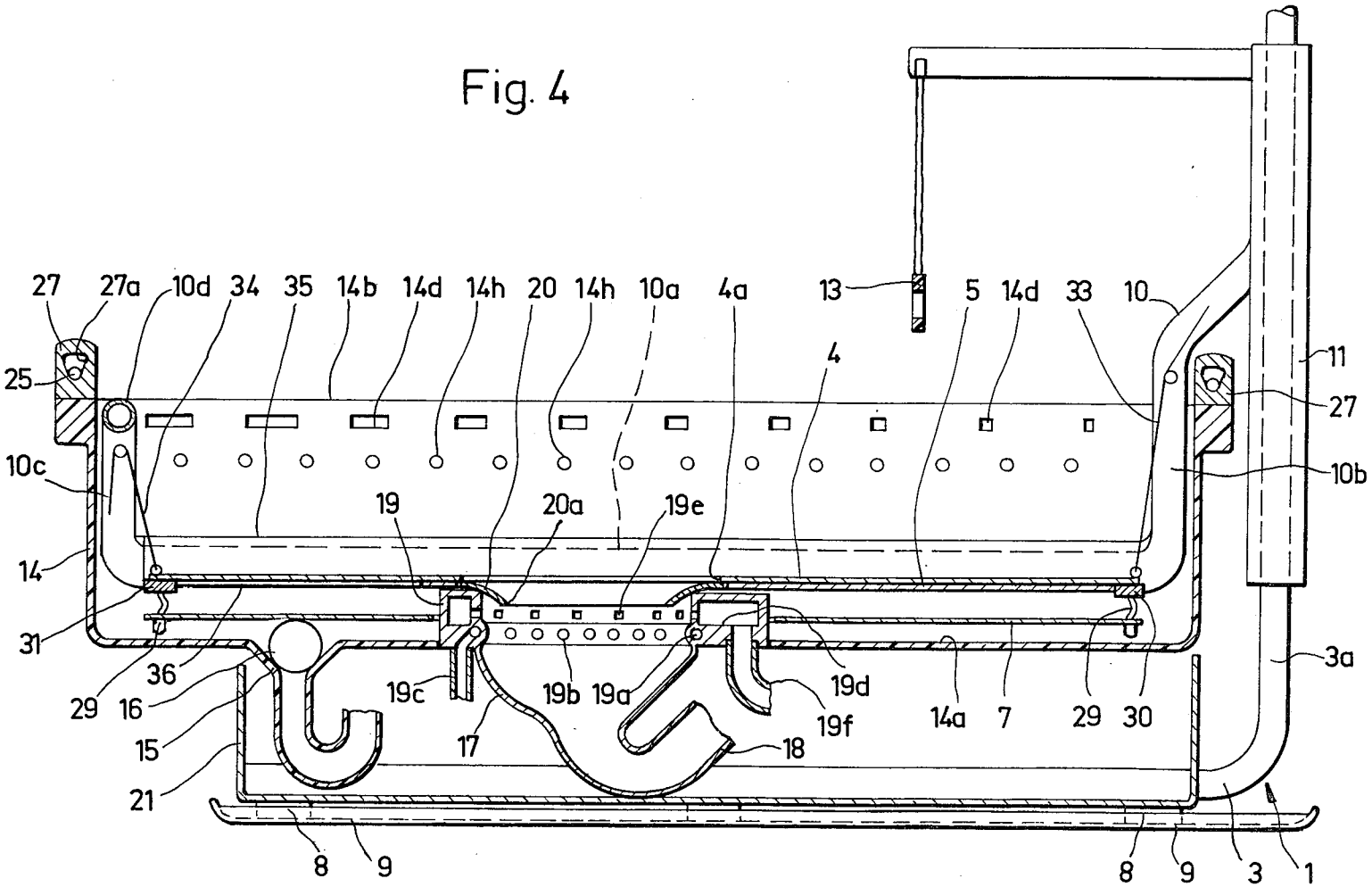
FIG. 4 is a cross-sectional view through the bed with the support frame in its lowered position and taken substantially along the line IV—IV of FIG. 1.
Figure 5:
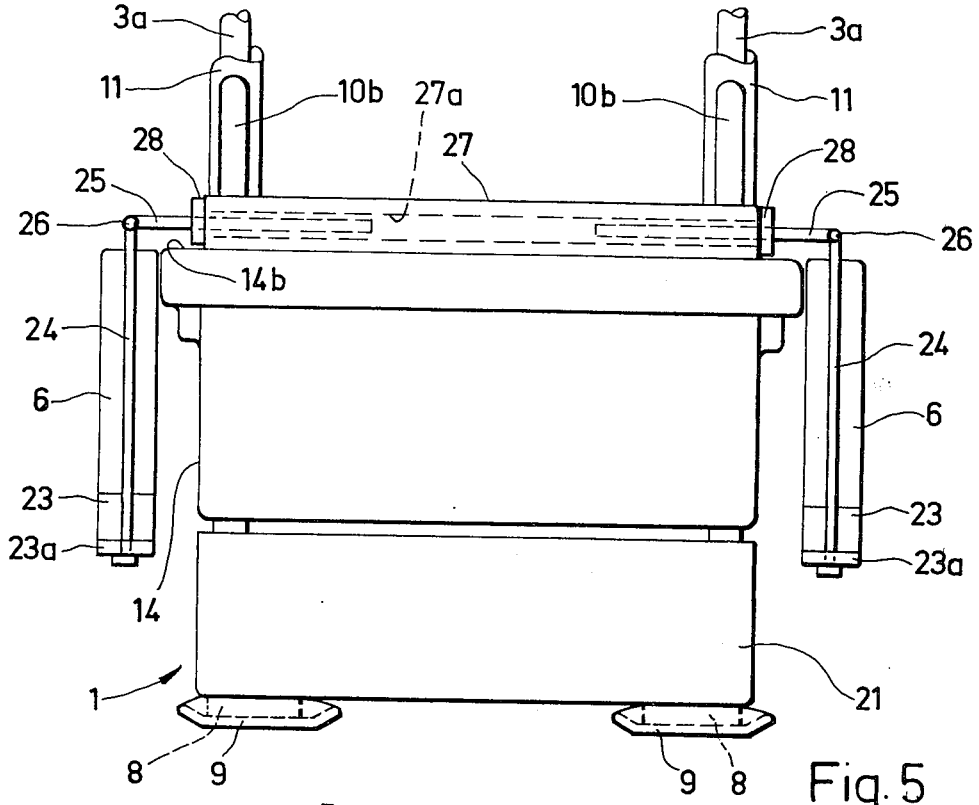
FIG. 5 is a front view looking in the direction of the arrow V of FIG. 2 of a bed with the cushion elements removed and the support frame lowered.

In the normal repose-position the support frame 10 and the cushion element 2, as already mentioned, are located in the position shown in FIGS. 1, 2 and 3. If the person lying on the bed now wishes to take a bath, then he or she or an attendant first removes the bed sheets lying upon the upper portion 4. In the event that the bed is located in the room of a hospital accommodating still further patients, then prior to bathing it is furthermore advantageous to erect around the bed a portable screen or equivalent structure. However, it is also possible to provide at the ceiling of the room or at the bed itself a curtain which the reclining patient can close by means of a drawstring or the like. Thereafter the patient removes both of the cushion element-components 6 out of the region of the upper portion 4 by means of the cushion element-displacement device 24, 25 and 27. During the removal operation the components 6 are displaced at both sides towards the outside and finally tilt downwards into the position shown in FIG. 5. The reclining patient is now supported by the upper component or portion 4 which, in turn, is supported by the support frame 10 and additionally supported by the intermediate portion 5 as well as the traction cables 36 and 37. In the event such has not already occurred, then the intermediate portion 5 now is displaced into that terminal position in which it covers the opening of the toilet bowl 17. Thereafter the support frame 10 with the upper portion 4 connected therewith is lowered into the trough or tube 14 until it arrives in the position shown in FIGS. 4 and 5, wherein the intermediate portion 5 has been shown in FIG. 4 in the terminal position in which it frees the opening of the toilet bowl. On the other hand, if the intermediate portion 5 is located in the other terminal position provided for bathing, then it bears upon the toilet bowl-seating ring 20 and sealingly closes the toilet bowl towards the interior of the trough 14.

The intermediate portion 5 thus forms a closure means by means of which the opening 20*a* of the toilet bowl 17 can be closed. Of course, it would also be possible to provide a closure means for closing-off the discharge or drain 18. During lowering of the support frame 10 and the upper portion 4 naturally also the lower portion 7 arrives within the confines of the trough or tub 14. Its opening 7*a* is dimensioned such that it can be penetrated by the marginal portion 19 of the toilet bowl 17. According to a particularly advantageous construction the closure element 16 is attached at the lower portion or component 7, so that the discharge 15 of the trough 14 during lowering of the support frame 10 is automatically closed and upon raising such support frame such is opened on the other hand. The trough or tub can now be filled with the aid of a mixing valve 39 mounted somewhat laterally at the head end of the bed and possessing a water faucet or tap and a spray head, so that the reposed patient can bathe and clean his or her body.

In order that the reposing patient during bathing does not catch cold and so that he or she can dry-off as well as also be able to dry the parts of the bed cushion 2 which are wet after bathing, the support frame 10 and the trough 14, the bed is advantageously equipped with a hot air-blower device. Such embodies a conventional and therefore not particularly illustrated hot air blower and a hot air channel which is formed by an opening 14*c* provided in one of the longitudinal sections of the trough-edge 14*b* and extending along such trough-edge. The infed hot air can flow out of the hot air channel or opening 14*c* through the openings 14*d* confronting the interior of the trough or tub 14. In the exemplary embodiment under discussion the hot air is delivered to the hot air channel 14*c* at the head end of the bed. In order to achieve a uniform distribution of air notwithstanding the drop in pressure towards the end of the hot air channel 14*c* the openings 14*d* are larger in the direction of the foot end of the bed.

The other lengthwise or longitudinal section of the trough-edge 14*b* is likewise equipped with an opening, designated by reference character 14*e*, and extending in the lengthwise direction of the bed, and from which the openings 14*f* corresponding to the openings 14*d* open into the interior of the trough or tube 14. The opening 14*e* serving as a vent channel is operatively connected with a conventional and therefore not particularly shown suction device and permits sucking-off the water vapors which form during bathing.

A section of one of both of the aforementioned channels 14*c* 14*e* additionally can serve as a water overflow means. Beneath the channels 14*c* and 14*e* there is arranged a respective further channel 14*g* from which nozzle-like constructed openings 14*h* lead into the interior space of the trough or tub 14. The channels 14*g* serving as flushing channels and their openings 14*h* form part of a flushing device which renders possible spraying and cleaning the inner surface of the trough 14 with a cleaning agent and/or water. The cleaning of the trough or tub 14 of course then first occurs after the support frame 10 with the person lying upon the upper portion 4 has again been displaced upwardly into the normal repose-position. Moreover, the upper portion, the intermediate portion and the lower portion are of course constructed such that when the bed is not used they can be removed relatively easily, so that an attendant or other individual, when necessary, can thoroughly clean the trough or tub 14.

When the trough has been cleaned with all parts and again been dried with the aid of the hot air-blower device, then by means of the cushion element-displacement or moving device 24, 25 and 27 the cushion element-components 6 are again brought into the repose-position, that is to say, beneath the upper portion 4. In so doing, the rods 25 with the traction cables engaging thereat are retracted into the opening 27*a* of the associated guide or guide member 27 and the cushion element-components 6 are raised, rocked into the horizontal position and again brought between the intermediate portion 5 and the lower portion 7. The foamed plastic elements 28 prevent possible injury to the patient if he is required to hold himself at one of the rods 25. Finally, the attendant again arranges the bed sheets and pillow on the bed cushion.

Continuing, it is to be appreciated that the toilet bowl 17 which is installed in the bed enables the person lying thereon to also carry out the usual body functions without having to leave the bed. Starting from the normal repose-position, also in this case there must again first be removed the bed sheets. Thereafter the cushion element-components 6 are brought into the position shown in FIG. 5. For using the toilet bowl 17, and in contrast to the previous discussion, in this case the intermediate portion or component 5 is left in the position shown in FIG. 2 or, in the event that it is not in such position, then it is brought into such position. Thereafter the support frame 10 with the upper portion 4 and the person lying on such upper portion are lowered into the trough 14 and brought into the position illustrated in FIG. 4. In the event the condition of health of the person lying on the bed permits, he or she can sit-up and, should it be necessary, can be supported by raising the end section of the upper portion 4 at the head end of the bed. According to a particularly advantageous construction the marginal portion 19 of the toilet bowl 17 is provided with a ring-shaped channel 19*a* from which there lead openings 19*b* serving as spray nozzles to the inside of the marginal portion. The channel 19*a* can be connected through the agency of a connection stud or pipe 19*c* with a hot water connection and serves for cleaning the waste of the person using the toilet. Moreover, the marginal portion 19 is provided at both sides with a respective channel 19*d* from which there open the openings 19*e* into the internal space of the toilet bowl 17. One of the channels 19*d* is connected via a connection stud 19*f* with a pump and serves as a vent channel for sucking-off the air. The other channel 19*d* can be connected with a hot air blower and serves to dry the body after cleaning. Of course, there is also present a standard toilet flushing device. The associated flushing cabinet can be arranged for instance at the head end of the bed between the vertical tubular or pipe sections 3*a*.

The water supply component required for the infeed of water to the mixing valve 39 and to the flushing channel 14*g* of the trough 14 as well as to the toilet bowl 17 and the toilet flushing cabinet is advantageously arranged beneath the trough 14 within the casing element 21, so that only a hot- and a cold water line or conduit must lead to the bed. Also the drains or discharges appropriately open into a collecting drain or discharge which is connected via a single drain or discharge conduit with a drain or discharge of the structure or building. In the event such is necessary the collecting discharge can also be equipped with a conveying pump and with a device for comminuting the waste or feces of the patient.

Figure 6:
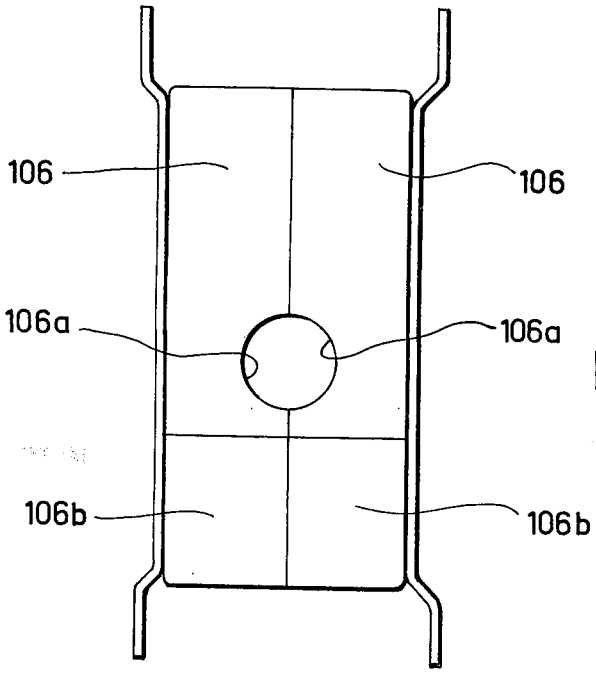
FIG. 6 is a plan view of a modified embodiment of a cushion element shown on a reduced scale.

The cushion element 6 can be modified in different ways. The cushion element-components 106 shown on a smaller scale in FIG. 6 are provided with a respective recess or opening 106*a* at the region located above the toilet bowl. When the cushion element 106 is located beneath the upper portion 4, then both of the recesses 106*a* collectively form an opening which is in alignment with the opening 4*a* of the upper portion 4 and the opening 20*a* of the toilet bowl 17. A cushion element constructed in this manner is particularly advantageous for use with patients who are not able to hold-back their body waste. Such body waste then arrives through the openings provided in the different parts of the bed cushion in the toilet bowl or possibly also in the trough. The latter thus can serve as an emergency toilet and when needed can be flushed with the aid of the flushing device possessing the flushing channels 14*g*.

In the case of patients suffering from heart ailments it is necessary in a great number of instances that the legs are located lower than the torso. In order to render this possible the cushion elements 106 can be provided at their side confronting the foot end of the bed with a respective section 106*b* which can be downwardly rocked or removed and replaced by a separate cushion. Of course, with such embodiment of the cushion element it is necessary that the connections or attachment means of the upper portion and the intermediate portion are constructed such that it is possible to lower the legs.

According to an especially advantageous construction of the invention the cushion element-movement or displacement device 24, 25 and 27 can be constructed such that the force can be changed by means of which both of the components 6 of the cushion element can be pushed against one another. In this way it is possible to accommodate the hardness of the cushion element to the requirements of the patient.

According to a still further constructional manifestation of the invention the bed can be additionally provided with a wash basin 40 which has only been shown in FIGS. 7, 8 and 9. The wash basin 40 has a drain or discharge 40*a* and a support surface 40*b* serving for supporting eating dishes or the like. The wash basin 40 is furthermore equipped with a mixing valve having a water faucet or tap 41 and advantageously a spray or shower head 42. The wash basin 40 is pivotably connected with the bed frame 1 through the agency of a pivot mechanism designated in its entirety by reference character 43. The pivot mechanism 43 possesses a bearing block 44 secured at the region of one of the lengthwise edges of the bed at the bed frame 1 at the height of the floor. This bearing block 44 forms a pivot bearing in which there is pivotably mounted a pivot arm 46 by means of the pivot or hinge head 45. The free end of the pivot or pivotal arm 46 is connected with a support column 49, the lower end of which is constructed as a support means 48 and bears upon the floor 53. The support means 48 is advantageously designed as a sliding runner or can be equipped with traveling rollers or casters which can be blocked, so that the pivotal arm 46 together with the support column 49 can be easily rocked or pivoted. The horizontal pivot arm 46 and the support column 49 are furthermore interconnected with one another by a reinforcement strut 47 or the like. At the upper end of the support column 49 there is hingedly connected by means of a pivot head or hinge arrangement 50 a further pivotal arm 51. At the free end of the pivotal arm 51 there is arranged a bearing sleeve 52 in which there is rotatably mounted the wash basin 40. The mixing valve and the drain of the wash basin can be connected through the agency of suitable hoses or via the components of the pivot mechanism with a central water supply component located beneath the trough 14 or with the common collecting drain, respectively.

The different parts which are to be moved when using the bed can be, for instance, all moved with the aid of traction cables or the like which can be actuated by means of a drive mechanism possessing for instance one or a number of electric motors. The drive mechanism can be controlled by means of a control unit which is arranged at a location which is readily accessible to the patient. It is of course also possible to provide the drive mechanism with hydraulic elements and to carry out the necessary movements hydraulically.

The previously described bed thus enables a sick or invalid person, who no longer can leave the bed under his own force, but however who is still fully in possession of his mental faculties, to be able to help himself without the assistance of an attendant over a time span of a number of hours. This is even then the case if the patient lying in the bed, after using the trough or the toilet bowl, is no longer capable of properly arranging the bed sheets and pillow and covering himself, since under these conditions, with the aid of the hot air-blower device, there can be readily maintained a sufficient temperature.

The drive mechanism or device serving to actuate the different movements and the associated control unit or device are of course constructed in such a way that there are eliminated erroneous manipulations which could cause damage or injury. In the event that the bedridden patient is no longer mentally capable of sensibly operating the control unit, then individual movement operations or all movement operations, as may be necessary, can be blocked by means of a blocking or locking device which can be unlocked by only an attendant. Even if the patient is unable to properly operate the control unit at all, then nonetheless the work of the attendant is considerably facilitated by virtue of the previously described construction of bed.

A further advantage of the bed of this development resides in the fact that it is also suitable for use with patients who cannot stand being covered by a blanket or the like. In such case the support frame can be lowered into the trough or tub and with the aid of the hot air-blower device there can be maintained the required temperature to keep the patient comfortable.

The bed is advantageously constructed in such a way that its components, in the disassembled condition, all can be transported through normally dimensioned door openings, so that the bed can not only be erected in hospitals, but also quite easily in the rooms of standard apartments or homes. This has the advantage that many older persons who cannot get around easily, and who otherwise would have to be confined to a hospital or nursing home, can be taken care of by members of their family, even if such family members are away during the day a number of hours.

Of course, it is possible to modify the bed in accordance with the requirements of the patient and to equip it, for instance, only with a part of the previously described devices. In the event there is provided a wash basin with a shower head equipped with a hose, than such can be readily also used for filling the tub or trough 14, so that the mixing valve 39 and the therewith associated shower head can be omitted.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. A bed intended for use with sick and invalid persons, comprising a bed frame, bed cushion means provided for the bed frame, said bed frame including a vertically adjustable support frame, said bed cushion means comprising a cushion element and an upper portion arranged above the cushion element and supported by the vertically adjustable support frame, displacement means for the cushion element, said displacement means serving to displace the cushion element out of the region of said upper portion and to again bring such below such upper portion, said bed frame being equipped with a trough provided with a closable discharge, the upper portion of the bed cushion means can be lowered into said trough when the cushion element has been removed out of the region of the upper portion, said cushion element comprises two components extending essentially in the lengthwise direction of the bed, said two components being separated by a substantially vertically extending separation surface, the bed frame having a head end and a foot end, the cushion element-displacement means being provided at both the head end and the foot end with a respective guide member secured to the bed frame and extending in the transverse direction of the bed, and guide elements connected with the cushion element-components displaceably guided in said guide members.

2. The bed as defined in claim 1, wherein the trough is equipped with a flushing channel serving for the flushing of said trough, the trough defining therein an internal space, and means defining openings extending from the flushing channel into the internal space of the trough.

3. The bed as defined in claim 1, wherein the trough is equipped with a hot air channel serving to deliver hot air, said trough defining therein an internal space, and means providing openings extending from the hot air channel into the internal space of the trough.

4. The bed as defined in claim 1, further including a toilet bowl provided with a drain fixedly connected with the trough, said toilet bowl having a marginal portion, said trough having a floor, said marginal portion of the toilet bowl being arranged at the central region of the trough floor, the toilet bowl possessing an opening, the upper portion of the bed cushion possessing an opening which frees the opening of the toilet bowl, and closure means provided for the toilet bowl.

5. The bed as defined in claim 4, wherein the closure means serves to close-off the toilet bowl.

6. The bed as defined in claim 4, wherein the closure means serves to close-off the drain of the toilet bowl.

7. The bed as defined in claim 4, wherein said closure means provided for the toilet bowl comprises an intermediate portion arranged between the upper portion of the bed cushion means and the cushion element, said intermediate portion possessing an opening, means for connecting the intermediate portion with the support frame to permit the intermediate portion to be displaced in the lengthwise direction of the bed between two terminal positions, and wherein said intermediate portion is constructed such that in one of its terminal positions it covers the opening of the toilet bowl and with the upper portion lowered closes-off such opening, and wherein the opening of the intermediate portion frees the opening of the toilet bowl when said intermediate portion is in its other terminal position.

8. The bed as defined in claim 1, wherein the upper portion and the cushion element each have a respective opening, and wherein said last-mentioned openings are substantially in alignment with one another when the cushion element is located beneath the upper portion.

* * * * *